US006012269A

United States Patent [19]

Vitti

[11] Patent Number: 6,012,269

[45] Date of Patent: Jan. 11, 2000

[54] METHOD OF MARKING AND PACKAGING GOLF BALLS

[76] Inventor: Vincent E. Vitti, 45 Twinbrooks Rd., Saddle River, N.J. 07458

[21] Appl. No.: 09/197,255

[22] Filed: Nov. 20, 1998

[51] Int. Cl.[7] ..... B65B 35/30

[52] U.S. Cl. ..... 53/428; 53/443; 206/315.9; 40/327

[58] Field of Search ..... 40/327; 53/428, 53/443; 101/DIG. 40; 206/315.9; 473/351, 353, 409

[56] References Cited

U.S. PATENT DOCUMENTS 676,506 6/1901 Knight et al. .
906,932 12/1908 Riblet .
3,047,140 7/1962 Robins .
4,235,441 11/1980 Ciccarello .
4,972,948 11/1990 Saiki et al. .
5,013,046 5/1991 Koch .
5,195,633 3/1993 Kaminski .
5,542,680 8/1996 Proudfit et al. .
5,651,741 7/1997 Matsutani et al. .
5,713,803 2/1998 Oshima .

*Primary Examiner*—Daniel B. Moon
*Attorney, Agent, or Firm*—Baker & Botts, L.L.P.

[57] ABSTRACT

A method of marking and packaging golf balls in which each golf ball in a box or package is marked with a common multi-digit indicia and by a separate marking separately identifying each ball in the box or package and in which all of the golf balls in another box or package are marked with another common multi-digit indicia which differs from the previous package according to a predetermined sequence.

5 Claims, 1 Drawing Sheet

METHOD OF MARKING AND PACKAGING GOLF BALLS

SPECIFICATION

BACKGROUND OF THE INVENTION

This invention relates to a method of marking and packaging golf balls to help identify each player's golf ball and distinguish it from all other golf balls in play on the golf course.

The game of golf is played on the same region of a golf course by a number of players, and it has been a recognized problem to identify each player's particular golf ball and distinguish it from all of the other golf balls of other players in the same region.

The golf balls in a box or package are generally marked in sets "1", "2", "3" and "4", but players on the same golf course at any given time may use the same brand name having the same numeral. Players often improvise their own distinctive markings as an aid in identifying their particular ball in play.

The present invention relates to a novel method of marking and packaging golf balls intended to solve this problem of long standing.

SUMMARY OF THE INVENTION

The present invention relates to a method of marking and packaging golf balls by the steps of marking each golf ball in a package with a distinct indicia so that each golf ball in the package can be distinguished from all of the other golf balls in the same package, marking all of the golf balls in the package with the same multi-digit indicia selected from a predetermined sequence and changing the multi-digit indicia for each successive package according to the predetermined sequence. The present invention also relates to a package of golf balls made by this method.

One preferred embodiment of the invention is to mark a common multi-digit serial number on all of the golf balls in a box or package along with an additional marking, for example, "1" "2" "3", etc. separately identifying each ball in the box or package from the others and marking all the golf balls in the next box or package with the next higher multi-digit serial number along with markings separately identifying each ball, so that the golf balls in each box or package will have a common marking unique for each box or package and, in addition, a distinct marking for each ball in the box or package.

For a more complete understanding of the present invention, reference should be made to the description which follows and to the accompanying drawings.

DESCRIPTION OF PREFERRED EMBODIMENTS

Figure 1:
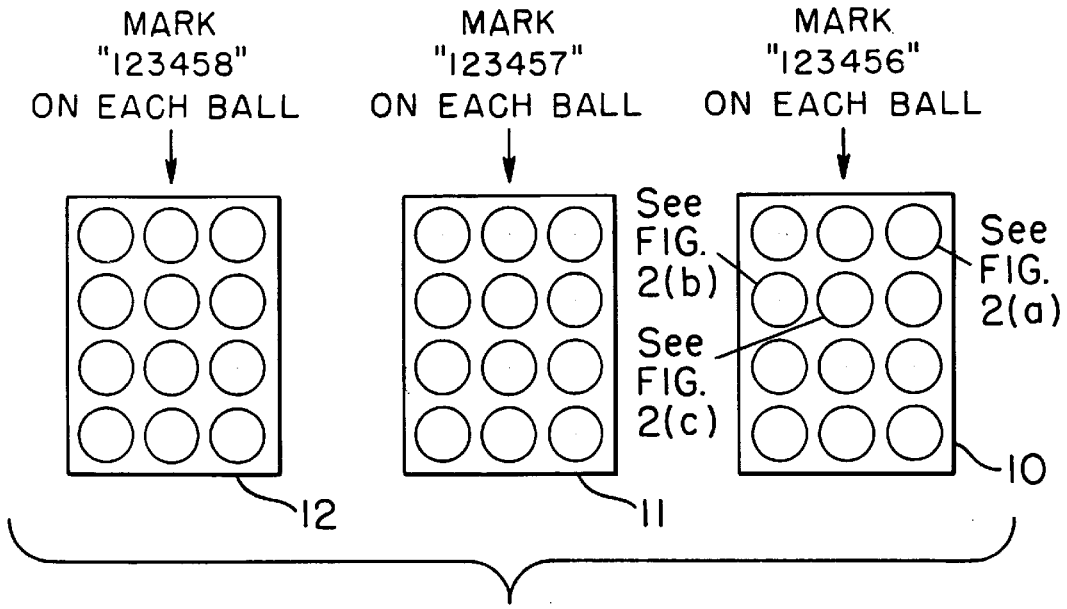
FIG. 1 is a schematic illustrating three boxes or packages, each containing a dozen golf balls, in which the golf balls in each package or packages are marked with the same multi-digit indicia which changes from package to package in a predetermined sequence.

In the method of marking and packaging golf balls in accordance with the present invention, as shown in FIG. 1, all of the golf balls in a box or package are marked with a common multi-digit identification indicia, for example, all of the golf balls in the box or package 10 are marked "123456", all of the golf balls in the box or package 11 are marked "123457" and all of the golf balls in the box or package 12 are marked "123458", etc. The common multi-digit indicia changes from box to box according to a predetermined sequence, in the example shown, in a numerical sequence.

Figure 2A:
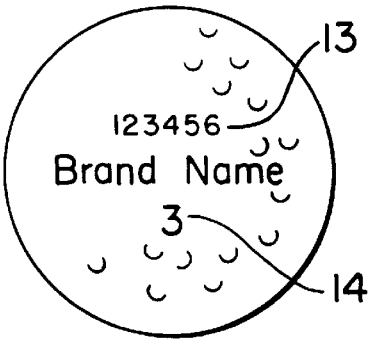
FIGS. 2(*a*), 2(*b*), 2(*c*) show three golf balls from the same package marked with a common multi-digit indicia and, in addition, a marking separately identifying each golf ball.
Figure 2B:
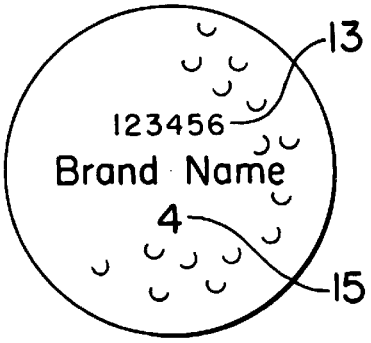
Figure 2C:
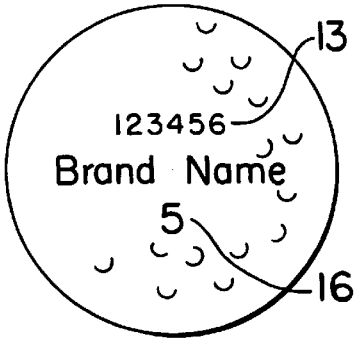

In addition to the common multi-digit identification indicia on the golf balls in each box or package, there is an additional marking separately identifying each ball in the box or package 10, 11 and 12, for example, "1", "2", "3", etc. In FIG. 2, three golf balls from the box or package 10 are shown with the common multi-digit identification indicia "123456" indicated by the reference numeral 13 and the marking "03", "04", "05" separately identifying each ball in the box or package indicated by the reference numerals 14, 15, 16.

The use of a six-digit common identification number for the dozen balls in each box or package affords 999,999 variations before repeating the sequence, so that it is unlikely that two balls having the same number will be in play on a golf course at any given time. Needless to say, the common indicia may be expressed by fewer digits. Further, if two balls from the same box or package are in use at the same time the balls can be distinguished by the marking separately identifying each ball in the box or package.

Figure 3:
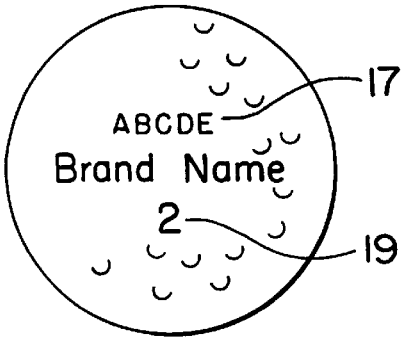
FIG. 3 shows a golf ball in which the multi-digit indicia is expressed in letters and the marking separately identifying each ball is expressed in a numeral.
Figure 4:
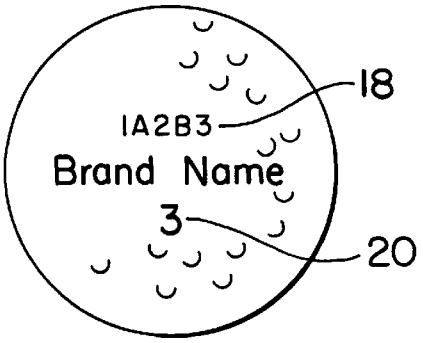
FIG. 4 shows a golf ball in which the multi-digit marking includes both letters and numerals and the marking separately identifying each ball is expressed in a numeral.

The multi-digit common indicia for each box or package can be expressed other than in numerals, as illustrated in FIGS. 1 and 2. For example, it can be expressed in letters as indicated by 17 in FIG. 3, in combinations of numbers and letters as indicated by 18 in FIG. 4 or by any other multi-digit indicia in which each digit can be changed in a predetermined sequence, such as 1, 2, 3, 4 etc. or a, b, c, d etc. or by other symbols or indicia to which a predetermined sequence is established by the person who imprints the multi-digit indicia on the golf balls. In FIGS. 3 and 4, the distinctive ball markings are indicated by the reference numerals 19 and 20.

The invention has been shown and described in preferred forms and by way of example, and other modifications and variations can be made within the scope of the claims.

I claim:

1. A method of marking and packaging golf balls comprising the steps of marking each golf ball in a package with distinctive indicia so that the golf ball in the package can be distinguished from all of the other golf balls in the package, marking all of the golf balls in the package with the same multi-digit indicia and changing the multi-digit indicia in each successive package according to a predetermined sequence.

2. A method as set forth in claim 1 in which the multi-digit indicia includes at least one number and in which at least one of the numbers is changed in a predetermined numerical sequence for different packages.

3. A method as set forth in claim 1 in which the multi-digit indicia includes at least one letter and in which at least one of the letters is changed in a predetermined alphabetical sequence for different packages.

4. A method as set forth in claim 1 in which the multi-digit indicia is a combination of numbers and letter and in which at least one of the digits is changed in a predetermined sequence from package to package.

5. A package of golf balls made by the method set forth in claim 1.

* * * * *